US010196245B2

(12) United States Patent
Chai et al.

(10) Patent No.: US 10,196,245 B2
(45) Date of Patent: Feb. 5, 2019

(54) APPARATUS AND METHOD FOR DETECTING AND PROTECTING TELESCOPIC OIL CYLINDER OF CRANE

(71) Applicant: Xuzhou Heavy Machinery Co., Ltd., Xuzhou (CN)

(72) Inventors: Junfei Chai, Xuzhou (CN); Huapeng Cui, Xuzhou (CN); Hongmin Zhang, Xuzhou (CN); Lei Li, Xuzhou (CN); Cuiping Wang, Xuzhou (CN)

(73) Assignee: Xuzhou Heavy Machinery Co., Ltd., Xuzhou (CN)

( * ) Notice: Subject to any disclaimer, the term of this patent is extended or adjusted under 35 U.S.C. 154(b) by 245 days.

(21) Appl. No.: 15/186,403

(22) Filed: Jun. 17, 2016

(65) Prior Publication Data

US 2016/0289050 A1 Oct. 6, 2016

Related U.S. Application Data

(63) Continuation of application No. PCT/CN2014/087241, filed on Sep. 24, 2014.

(30) Foreign Application Priority Data

Dec. 20, 2013 (CN) ..... 2013 1 0710689

(51) Int. Cl.
*B66C 13/20* (2006.01)
*B66C 23/70* (2006.01)
(Continued)

(52) U.S. Cl.
CPC ..... *B66C 23/705* (2013.01); *B66C 13/20* (2013.01); *B66C 15/00* (2013.01); *F15B 11/08* (2013.01);
(Continued)

(58) Field of Classification Search
CPC ... F15B 13/044; F15B 13/0401; B66C 23/705
See application file for complete search history.

(56) References Cited

U.S. PATENT DOCUMENTS 4,185,426 A 1/1980 Prescott
6,647,718 B2 * 11/2003 Stephenson ..... B66C 23/88 414/708
(Continued)

FOREIGN PATENT DOCUMENTS

CN 201154878 Y 11/2008
CN 202829338 U 3/2013
(Continued)

OTHER PUBLICATIONS

Extended European Search Report dated Jul. 3, 2017 in EP Patent Application No. 14872677.1. 8 pages.

*Primary Examiner* — Thomas E Lazo
(74) *Attorney, Agent, or Firm* — Kilpatrick Townsend & Stockton LLP

(57) ABSTRACT

An apparatus for a crane comprises a large-cavity pressure sensor, a small-cavity pressure sensor, a controller, a telescopic oil cylinder, and a telescopic oil cylinder regulator. The large-cavity pressure sensor can measure the oil pressure in a large cavity of the telescopic oil cylinder. The small cavity pressure sensor can measure the oil pressure in a small cavity of the telescopic oil cylinder. The controller can control an output electrical signal according to a large-cavity oil pressure fed back by the large-cavity pressure sensor and a small-cavity oil pressure fed back by the small-cavity pressure sensor, and, by means of the electrical signal, control a change of the amount of hydraulic oil flowing into and out of the large cavity and the small cavity of the telescopic oil cylinder so as to regulate the oil pressures in the large cavity and the small cavity.

14 Claims, 5 Drawing Sheets

(51) Int. Cl.

| | |
|---|---|
| ***B66C 15/00*** | (2006.01) |
| ***F15B 11/08*** | (2006.01) |
| ***F15B 13/04*** | (2006.01) |
| ***F15B 13/044*** | (2006.01) |

(52) U.S. Cl.
CPC ..... *F15B 13/0401* (2013.01); *F15B 13/044* (2013.01); *F15B 221I/426* (2013.01)

(56) References Cited

U.S. PATENT DOCUMENTS

| | | | | |
|---|---|---|---|---|
| 6,662,705 | B2 * | 12/2003 | Huang | F15B 11/006 60/459 |
| 7,066,446 | B2 * | 6/2006 | Nielsen | F15B 11/042 251/129.08 |
| 2003/0106313 | A1 | 6/2003 | Huang et al. | |
| 2010/0180585 | A1 * | 7/2010 | Elliott | B66C 13/20 60/327 |

FOREIGN PATENT DOCUMENTS

| | | | |
|---|---|---|---|
| CN | 103644172 | A | 3/2014 |
| EP | 1300595 | A2 | 4/2003 |
| GB | 2298291 | A | 8/1996 |
| GB | 2406363 | A | 3/2005 |
| GB | 2437615 | A | 10/2007 |
| JP | H09216786 | A | 8/1997 |
| JP | 2004091142 | A | 3/2004 |
| JP | 2006056715 | A | 3/2006 |

* cited by examiner

APPARATUS AND METHOD FOR DETECTING AND PROTECTING TELESCOPIC OIL CYLINDER OF CRANE

CROSS-REFERENCES TO RELATED APPLICATIONS

This application is a continuation application of PCT application PCT/CN2014/087241 entitled "APPARATUS AND METHOD FOR DETECTING AND PROTECTING TELESCOPIC OIL CYLINDER OF CRANE," filed on Sep. 24, 2014, which claims priority to Chinese Patent Application No. 201310710689.2, filed on Dec. 20, 2013, which are herein incorporated by reference in their entirety for all purposes.

FIELD OF THE INVENTION

The present invention relates to the field of cranes with telescopic booms, and particularly relates to an apparatus and method for detecting and protecting a telescopic oil cylinder of a crane.

BACKGROUND OF THE INVENTION

Since the hoisting performance of a main boom of a crane may be improved significantly by a single-cylinder pin-plug-in telescopic system, the system is widely used in large/medium tonnage crane products.

One end of a telescopic oil cylinder piston rod of the single-cylinder pin-plug-in system is fixed on the main boom, and a telescopic oil cylinder barrel slides in the sliding groove within each boom. Connections and separations between the telescopic oil cylinder and booms can be achieved through different combinations of a boom pin and a cylinder pin on the telescopic oil cylinder, and then stretching and contracting with a boom and stretching and contracting with the cylinder being idle can be achieved.

FIG. 1 is an exemplary schematic diagram of a dual-boom single-cylinder pin-plug-in telescopic system, wherein a telescopic oil cylinder can drive, through a cylinder pin, a secondary boom to stretch and contract, and a boom pin is used for connecting the secondary boom rigidly with the main boom. In practical application, the combination mostly includes five or more booms.

With a plurality of states such as stretching with a boom, contracting with a boom, stretching with the cylinder being idle and contracting with the cylinder being idle, different variable amplitude angles, and the number and combined operating conditions of telescopic booms, the load of the corresponding telescopic oil cylinder is not the same, and thus the value of oil pressure in the telescopic oil cylinder is not the same. The larger the opening of the solenoid valve on the oil way pipeline, the larger the flow and the swifter the stretching and contracting motion, so that regulating the opening size of the solenoid valve is a demanding task in order to ensure the smoothness of the stretching and contracting motion.

When oil leakage caused by damage of the oil way pipeline and damage of the valve circuit happens, the pressure in the telescopic oil cylinder cannot build up, and thus the value of the oil pressure will be relatively small. For example, as shown in FIG. 1, after the secondary boom stretches out, if the hydraulic oil in the large cavity is leaked off completely due to trouble in the large-cavity oil way, then after the boom pin is pulled off, there is no pressure support in the large cavity, so subjected to the gravity of the cylinder and the telescopic boom itself and under the huge pressure action of the small-cavity oil pressure, the stretching boom will fall rapidly, and it is very easy to cause the damage of the vehicle and a safety accident.

When the resistance to the stretching and contracting motion of the telescopic oil cylinder becomes greater due to the deformation of the main boom under force, lack of lubrication and maintenance for a long time, etc., so that the main boom cannot normally stretch and contract, it is easy to cause the pressure in the cylinder to be too high, and forced pressurization will cause damage to the whole system.

When it is detected that the end boom fails, the telescopic oil cylinder stretches excessively and the head of the telescopic oil cylinder collides with the head of the main boom, affected by the instant impact, the fluctuation in oil pressure will be very violent.

In the case of contracting with a boom, the pressure of the large cavity should be a bit lower than that of the small cavity; if the pressure difference is too large, the speed of contracting will be too fast; if the pressure difference is too small, the motion will be too slow. The system smoothness performance may be improved by real-time regulation of the solenoid valve and oil pump according to the pressure difference value.

In the prior art, the overflow valve technique is often used to prevent the oil pressure from being too high: an overflow valve is added to the hydraulic oil way pipeline, and when the oil pressure reaches the upper limit value of the overflow valve, the hydraulic oil flows back to the oil tank through the overflow valve, so as to ensure that the pressure in the oil way is not higher than a certain upper limit value, and then protect the system safety. However, the overflow valve technique can only ensure that the oil way pressure is not higher than a certain upper limit value, but the change in oil pressure cannot be known clearly. When the oil pressure is too low, the information about the oil pressure cannot be obtained, and at the same time the pump, solenoid valve and engine, etc. cannot be regulated or otherwise treated accordingly.

A boom position detection technique is also used in the prior art. According to that technique, the position of each bloom is detected by a proximity switch, and the boom position information, namely which boom's range the telescopic oil cylinder is within, is determined. When the end boom is detected, a corresponding judgment is made, so as to prevent overstretching of the cylinder. However, according to the boom position detection technique, the preventive effect can be exerted only on the overstretching, but when the boom stretching speed is too fast so that the cylinder and the head of the main boom collide, no corresponding treatment is given.

In addition, also used in the prior art is a telescopic oil cylinder length measuring technique: the stretching/contracting length of the single-cylinder pin-plug-in telescopic oil cylinder is measured by a boom position length sensor. However, that technology is only for detection of the results, and the reason why the stretching speed becomes faster or slower, or why incapability of stretching occurs cannot be determined.

In the prior art, mainly by operating a control handle, an operator controls the size of the solenoid valve opening and/or the pump displacement, and then controls the speed of the stretching and contracting motion. For example, the more the control handle is turned, the larger the solenoid valve opening and the flow are, the swifter the stretching and contracting motion will be. However, this way is based on the operator's operation on the control handle, so that a high requirement on the operator's operational skill is imposed. In addition, there is no quantified feedback information on the controlled variable of the controlled object (stretching/contracting speed of the telescopic oil cylinder). Thus, it is difficult to ensure the smoothness and safety of the system.

Actually, it is often difficult to pull the boom pin in the single-cylinder pin plug-in system. There are two main reasons: 1) the oil pressure in the telescopic oil cylinder cannot build up, the boom cannot stretch out, and thus the boom pin cannot be unhooked; and 2) the boom pin cylinder fails, so the boom pin cannot be pulled off. However, based on the prior art, the reason why the boom pin cannot be pulled out still cannot be determined.

All of the above examples have actually occurred, so it is necessary to detect the state of the telescopic oil cylinder.

BRIEF SUMMARY OF THE INVENTION

The inventors of the present invention find that problems exist in the above mentioned prior art, and thus provide a new technical solution for at least one of the problems.

In one aspect of the present invention, provided is an apparatus for detecting and protecting a telescopic oil cylinder of a crane, including a large-cavity pressure sensor, a small-cavity pressure sensor, a controller, a telescopic oil cylinder, and a telescopic oil cylinder regulator, wherein the large-cavity pressure sensor is connected respectively with the telescopic oil cylinder and the controller; the small-cavity pressure sensor is connected respectively with the telescopic oil cylinder and the controller; the controller is connected with the telescopic oil cylinder regulator; and the telescopic oil cylinder regulator is connected with the telescopic oil cylinder.

The apparatus further includes the features that the large-cavity pressure sensor measures the large-cavity oil pressure of the telescopic oil cylinder; the small-cavity pressure sensor measures the small-cavity oil pressure of the telescopic oil cylinder; and the controller controls an electrical signal output to the telescopic oil cylinder regulator according to a large-cavity oil pressure fed back by the large-cavity pressure sensor and a small-cavity oil pressure fed back by the small-cavity pressure sensor, and, by means of the electrical signal, controls a change of the amount of hydraulic oil flowing into and out of the large cavity and the small cavity of the telescopic oil cylinder, so as to regulate the oil pressure in the large cavity and the small cavity.

The apparatus further includes the features that the large-cavity pressure sensor and the small-cavity pressure sensor are respectively located in the cavity of the telescopic oil cylinder or oil way pipeline.

The apparatus further includes the features that the telescopic oil cylinder regulator refers to a solenoid valve, an oil pump, or an engine and oil pump.

The apparatus further includes the features that the controller is connected with the solenoid valve, or the controller is connected with the oil pump, or the controller is successively connected with the engine and oil pump, so as to control a change of the amount of hydraulic oil flowing into and out of the large cavity and the small cavity by changing engine speed, oil pump displacement or solenoid valve opening size.

The apparatus further includes: a proximity switch and/or a length measuring device, wherein the proximity switch is respectively connected with the controller and the telescopic oil cylinder, and the length measuring device is respectively connected with the controller and the telescopic oil cylinder.

The apparatus further includes the features that the controller determines whether the large-cavity oil pressure and the small-cavity oil pressure do not exceed limit values, whether the oil pressure difference between the large cavity and the small cavity is normal, and whether the fluctuation in oil pressures in the large cavity and the small cavity is normal, and, if yes, regulates the oil pressures in the large cavity and the small cavity according the oil pressures fed back.

The apparatus further include the features that if the controller determines that the large-cavity oil pressure and the small-cavity oil pressure exceed limit values, the oil pressure difference between the large cavity and the small cavity is abnormal, and/or the fluctuation in oil pressures in the large cavity and the small cavity are abnormal, the abnormality is treated.

In another aspect of the present invention, provided is a method for detecting and protecting a telescopic oil cylinder of a crane, including the steps that the large-cavity pressure sensor measures the large-cavity oil pressure of the telescopic oil cylinder; the small-cavity pressure sensor measures the small-cavity oil pressure of the telescopic oil cylinder; and the controller controls an output electrical signal according to a large-cavity oil pressure fed back by the large-cavity pressure sensor and a small-cavity oil pressure fed back by the small-cavity pressure sensor, and, by means of the electrical signal, controls a change of the amount of hydraulic oil flowing into and out of the large cavity and the small cavity of the telescopic oil cylinder, so as to regulate the oil pressures in the large cavity and the small cavity.

The method further includes the steps that the controller is connected with the solenoid valve, or the controller is connected with the oil pump, or the controller is successively connected with the engine and oil pump, so as to control an electrical signal output to the solenoid valve, oil pump or engine, and by means of the electrical signal, change the engine speed, oil pump displacement or solenoid valve opening size and then control a change of the amount of hydraulic oil flowing into and out of the large cavity and the small cavity of the telescopic oil cylinder.

The method further includes the steps that the controller determines whether the large-cavity oil pressure and the small-cavity oil pressure does not exceed limit values, whether the oil pressure difference between the large cavity and the small cavity is normal, and whether the fluctuation in oil pressures between the large cavity and the small cavity is normal, and, if yes, regulates the oil pressures in the large cavity and the small cavity according to the oil pressures fed back.

The method further includes the steps that if the controller determines that the large-cavity oil pressure and the small-cavity oil pressure exceed limit values, the oil pressure difference between the large cavity and the small cavity is abnormal, and/or the fluctuation in the oil pressures in the large cavity and the small cavity is abnormal, the abnormality is treated.

According to the present invention, the state of oil pressure in the telescopic oil cylinder is obtained by detecting the oil pressures in the large cavity and the small cavity of the telescopic oil cylinder of the single-cylinder pin plug-in system, and it is used for telescopic control of the telescopic oil cylinder, so as to help the system smoothly make a stretching and contracting motion.

In addition, according to the present invention, the abnormal state may also be determined and treated according to the oil pressures in the large cavity and the small cavity of the telescopic oil cylinder, so as to perform such functions as pressure indication, alarm processing and control logic optimization, and provide effective protection for the whole telescopic system.

Other features of the present invention and the advantages thereof will become apparent by the following detailed descriptions of an exemplary embodiment of the present invention with reference to the accompanying drawings.

BRIEF DESCRIPTION OF THE DRAWINGS

The drawings constituting a part of the specification illustrate the embodiments of the present invention, and together with the description, are intended to explain the principles of the present invention.

The present invention may be more clearly understood according to the following detailed descriptions with reference to the accompanying drawings, in which.

DETAILED DESCRIPTION OF THE EMBODIMENTS

Figure 1:
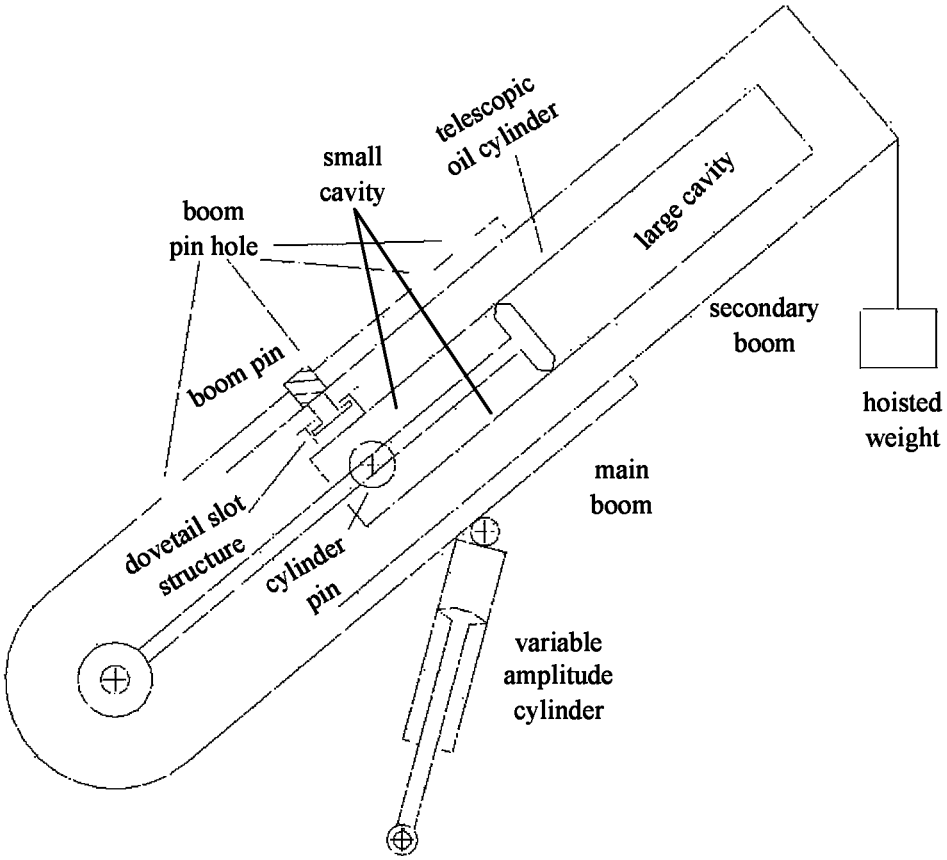
FIG. 1 is a schematic diagram of an exemplary dual-boom single-cylinder pin-plug-in telescopic system.

Various exemplary embodiments of the present invention will now be described in detail with reference to the accompanying drawings. It should be noted that unless otherwise specifically stated, the relative arrangement of the components and steps, the numerical expressions and numerical values set forth in these embodiments do not limit the scope of the invention.

Meanwhile, it should be understood that for convenience of description, the dimensions of each part illustrated in figures are not drawn according to actual proportional relationship.

The following description of at least one exemplary embodiment is merely illustrative in nature and is in no way intended to limit the invention, its application, or uses.

For those of ordinary skill in the relevant art, known techniques, methods and equipment may not be discussed in detail, but where appropriate, the techniques, methods and equipment should be considered as part of specification for granting.

In all the examples shown and discussed herein, any specific value is to be construed as merely illustrative, and not as a limitation. Thus, other examples of the exemplary embodiments may have different values.

It should be noted that like reference numerals and letters denote similar items in the following figures, and thus once an item is defined in one figure, it needs no further discussion in the subsequent figures.

To make the objects, technical solutions and advantages of the present invention more clear, the present invention is further described in detail below in conjunction with the specific embodiments with reference to the accompanying drawings.

Figure 2A:
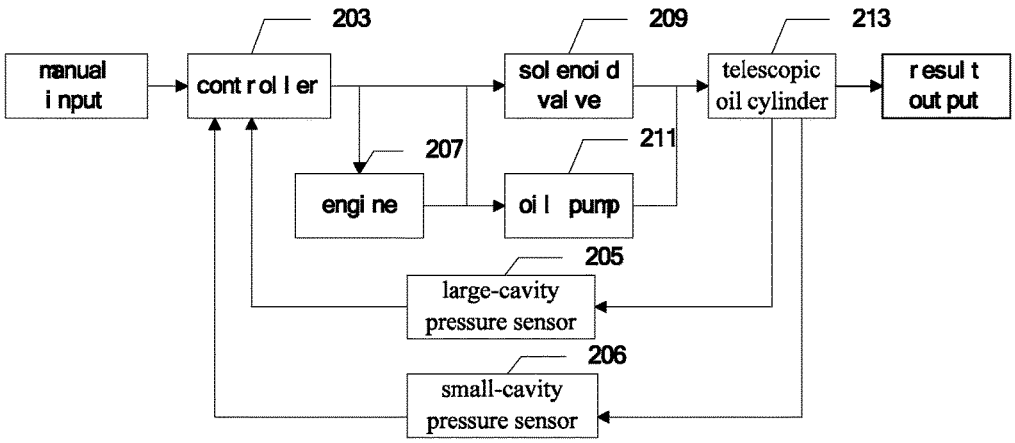
FIG. 2A is a block diagram of an apparatus for detecting and protecting a telescopic oil cylinder according to an embodiment of the present invention.

FIG. 2A is a block diagram of an apparatus for detecting and protecting a telescopic oil cylinder according to an embodiment of the present invention. The apparatus includes: a large-cavity pressure sensor 205, a small-cavity pressure sensor 206, a controller 203, a telescopic oil cylinder 213, and a telescopic oil cylinder regulator. Wherein:

The large-cavity pressure sensor 205 is respectively connected with the telescopic oil cylinder 213 and the controller 203.

The small-cavity pressure sensor 206 is respectively connected with the telescopic oil cylinder 213 and the controller 203.

The controller 203 is connected with the telescopic oil cylinder regulator. For example, the connection is a wired connection, capable of preventing outside interference.

The telescopic oil cylinder regulator is connected with the hydraulic oil way of the telescopic oil cylinder 213.

In the embodiment of the present invention, the connection means between each pressure sensor for the large cavity and the small cavity and the controller 203 include: analog signals (for example 4-20 mA), CAN (Controller Area Network) bus signals, and/or the like. The controller 203 may be: a PLC (Programmable Logic Controller), a single chip microcomputer, an ARM microcontroller, and/or the like.

In the embodiment of the present invention, the large-cavity pressure sensor 205 and the small-cavity pressure sensor 206 may be respectively located in the cavity of the telescopic oil cylinder and/or the oil way pipeline.

For example, the large cavity pressure sensor 205 is located in the large cavity, and the small cavity pressure sensor 206 is located in the small cavity; or the large cavity pressure sensor 205 is located on the oil way pipeline, and the small cavity pressure sensor 206 is located on the oil way pipeline; or the large cavity pressure sensor 205 is located in the large cavity, and the small cavity pressure sensor 206 is located on the oil way pipeline; or the large cavity pressure sensor 205 is located on the oil way pipeline, and the small cavity pressure sensor 206 is located in the small cavity.

The telescopic oil cylinder regulator mentioned herein refers to a solenoid valve 209 or an oil pump 211, or an engine 207 and oil pump 211. Certainly, in one embodiment, it may also include the engine 207, solenoid valve 209 and oil pump 211. As shown in FIG. 2A, the connection between the controller 203 and the telescopic oil cylinder regulator maybe: the controller is connected with the solenoid valve, or the controller is connected with the oil pump, or the controller is successively connected with the engine and oil pump, i.e., the oil pump is controlled by means of the engine.

According to the present invention, the large cavity pressure sensor and the small cavity pressure sensor are mounted on the telescopic oil cylinder, so that the pressures in the large cavity and the small cavity are known in real time, and taken as feedback information to control the telescopic oil cylinder for optimization in control logic. It is especially suitable for maintenance, repair and inspection of the crane. For example, that is suitable for the cases of pressure indication, of pressure alarm, where the pressure is relatively low due to oil leakage from a damaged oil way, of preventing the cylinder from blowing up, of preventing abrupt stretching, of preventing abrupt contracting, etc.

In an embodiment of the present invention, as shown in FIG. 2A, the "manual input" means that the operator tells the controller 203 the operating command to be executed, by means of a handle, a button, a touch screen, etc.

The controller is connected with the solenoid valve, or the controller is connected with an oil pump, or the controller is successively connected with the engine and oil pump.

The controller 203 controls an electrical signal (current value or voltage value) output to the engine, oil pump and/or solenoid valve according to the oil pressures fed back by the large-cavity pressure sensor and small-cavity pressure sensor, and by means of the electrical signal, changes the engine speed, oil pump displacement or solenoid valve opening size and then controls a change of the amount of hydraulic oil flowing into and out of the large cavity and the small cavity of the telescopic oil cylinder, so as to regulate the oil pressures in the large cavity and the small cavity. Accordingly, the more the oil flows into the cavity per unit time, the higher the pressure accordingly becomes; otherwise, the pressure becomes lower.

Regulation on the solenoid valve is as follows: one end of the valve element is subjected to a spring force, and the other end to an electromagnetic force; when the current or voltage given by the controller becomes higher, the electromagnetic force becomes stronger, then the open degree of the valve port is larger, and vice versa. The larger the opening is, the larger the flow of the hydraulic oil passing therethrough is.

For the oil pump, the pump itself has an inclined disk mechanism therein; the electromagnetic force is controlled by the voltage or current, the angle magnitude of the inclined disk is controlled by the electromagnetic force, and the angle magnitude determines the displacement of the oil pump.

For the engine, as long as the power control is developed by engine manufacturers, the torque and speed of the engine can be controlled by means of the CAN bus signal.

The operation whereby the controller 203 controls the stretching and contracting motion of the telescopic oil cylinder 213 according to the large-cavity oil pressure measured by the large-cavity pressure sensor 205 and the small-cavity oil pressure measured by the small-cavity pressure sensor 206 will be illustrated below in detail.

The controller 203 receives the large-cavity oil pressure and the small-cavity oil pressure, determines whether the large-cavity oil pressure and the small-cavity oil pressure do not exceed their respective limit values (including upper and lower limit values), whether the oil pressure difference between the large cavity and the small cavity is normal, and whether the fluctuation in oil pressures for the large cavity and the small cavity is normal, and, if yes, regulates the stretching and contracting motion of the telescopic oil cylinder according to the oil pressure. Here, the limit values means the upper limit and the lower limit, namely the upper limit of the large cavity, the lower limit of the large cavity, the upper limit of the small cavity, and the lower limit of the small cavity.

When the boom stretching motion is carried out, the telescopic oil cylinder regulator is regulated according to the oil pressure, so that the large-cavity oil pressure in the telescopic oil cylinder becomes higher, the small cavity has a back pressure (for the purpose of ensuring that oil exists in the cavity, so as to prevent such phenomena as 'abrupt stretching' and 'abrupt contracting' during the motion), and there is a process of being from great to small, stabilized, and then from small to great for the oil pressure difference between the large cavity and the small cavity, so that there is a process of motionlessness-acceleration-stable speed-deceleration-motionlessness when the boom stretches; here, the oil pressure is used for controlling the process, so that the acceleration and deceleration are controlled more smoothly, the smoothness performance for the boom stretching motion is improved, and the oil pressure difference in stable state is not greater than a first set value. The first set value may be set and changed according to need.

When boom contracting motion is carried out, the telescopic oil cylinder regulator is regulated according to the oil pressure, so that the small-cavity oil pressure in the telescopic oil cylinder becomes higher, the large cavity has a back pressure, and there is a process of being from small to great, stabilized, and then from great to small for the oil pressure difference between the small and large cavities, so that the smoothness performance for the boom contracting motion is improved, and the oil pressure difference in stable state is not greater than a second set value. The second set value may be set and changed according to need.

According to the present invention, the state of oil pressure of the telescopic oil cylinder is obtained by detecting the oil pressures in the large cavity and the small cavity of the telescopic oil cylinder of the single-cylinder pin plug-in system, and is used for stretching/contracting control of the telescopic oil cylinder, so as to help the system smoothly make a stretching and contracting motion.

In another embodiment of the present invention, if the large-cavity oil pressure and the small-cavity oil pressure exceed their respective limit values, the oil pressure difference between the large cavity and the small cavity is abnormal, and/or the fluctuation in oil pressures in the large cavity and the small cavity is abnormal, the abnormality is treated. According to an embodiment of the present invention, the sequence of treatment of the above-mentioned three kinds of abnormality may be: first to ensure that the oil pressures in the large cavity and the small cavity do not exceed the limit values (namely without big trouble in the system), then treat the abnormal oil pressure difference, and finally treat the abnormal fluctuation in oil pressure. Certainly, the scope of the present invention is not limited thereto.

According to the present invention, the abnormal state may also be determined and treated according to the oil pressures in the large cavity and the small cavity of the telescopic oil cylinder, so as to perform such functions as pressure indication, alarm processing and control logic optimization, etc. and effectively protect the whole telescopic system.

Figure 2B:
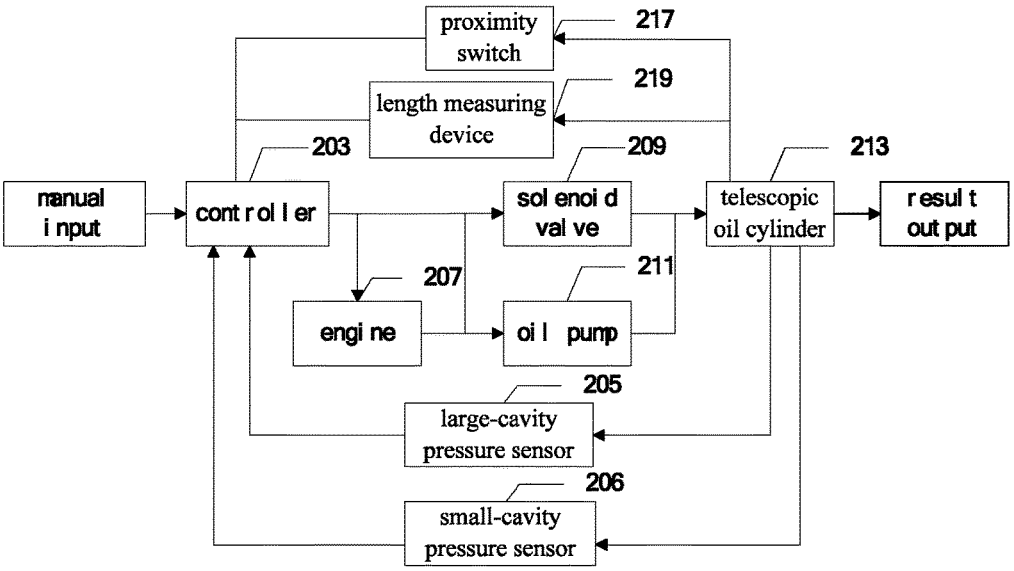
FIG. 2B is a block diagram of an apparatus for detecting and protecting a telescopic oil cylinder according to another embodiment of the present invention.

FIG. 2B is a block diagram of an apparatus for detecting and protecting a telescopic oil cylinder according to another embodiment of the present invention. In the embodiment of the present invention, the apparatus may further include a proximity switch 217 and/or a length measuring device 219. The proximity switch 217 is used to measure the position of the telescopic oil cylinder in the boom, and the length measuring device 219 is used to measure the stretching/contracting length of the telescopic oil cylinder. Accordingly, the proximity switch 217 is respectively connected with the controller and the telescopic oil cylinder, and the length measuring device 219 is respectively connected with the controller and the telescopic oil cylinder.

According to an embodiment of the present invention, the controller combines the boom information measured by the proximity switch 217 and length information measured by the length measuring device 219, together with the pressure information of the large-cavity pressure sensor 205 and small-cavity pressure sensor 206 to exert an optimization control over the stretching and contracting motion including stretching/contracting length, speed, etc., of the telescopic oil cylinder, so as to improve the control accuracy. For example, when the proximity switch 217 makes it known by measuring that the telescopic oil cylinder is located at the position of the secondary boom, and it is desired that the telescopic oil cylinder contracts to the main boom, the controller 203 controls the oil pump 211 and/or solenoid valve 209 to regulate the oil pressure in the telescopic oil cylinder (measured by the large cavity pressure sensor 205 and smell cavity pressure sensor 206), so that the small-cavity pressure is greater than the large-cavity pressure, and then the boom contracting motion is carried out; when the length measuring device 219 obtains the length information about the contracting boom by measuring, and the proximity switch 217 makes it known by measuring that the telescopic oil cylinder is located at the main boom, the controller 203 controls the oil pump 211 and/or solenoid valve 209 to regulate the oil pressures in the large cavity and the small cavity in advance, for example so that the oil pressures in the large cavity and the small cavity gradually tend to balance (due to the gravity of the telescopic oil cylinder itself, etc., when the motion stops, the pressures of the two cavities are not equal, but in a state of force balance), then the boom contracting motion is stopped.

Figure 3:
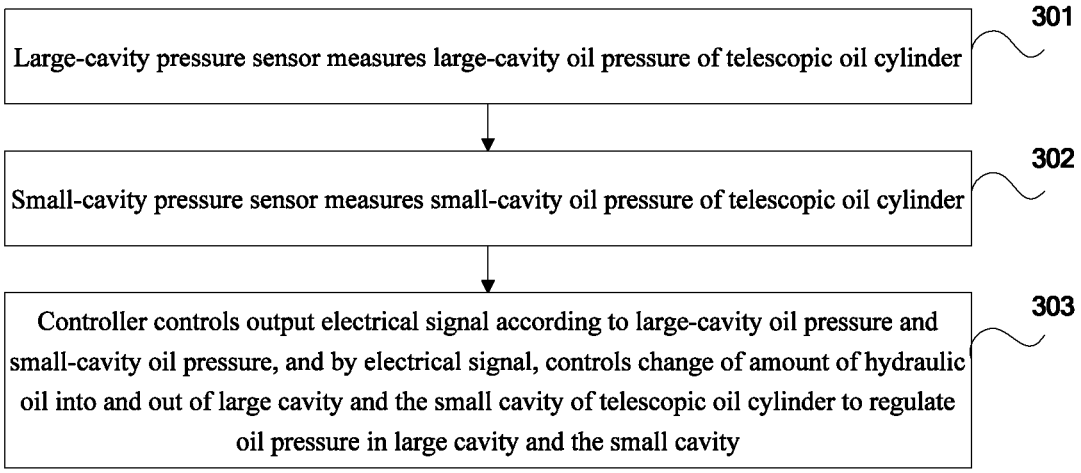
FIG. 3 is a schematic flowchart of a method for detecting and protecting a telescopic oil cylinder according to an embodiment of the present invention.

FIG. 3 is a schematic flowchart of a method for detecting and protecting a telescopic oil cylinder according to an embodiment of the present invention. That method includes the following steps:

In Step 301, the large-cavity pressure sensor measures the large-cavity oil pressure of the telescopic oil cylinder.

In Step 302, the small-cavity pressure sensor measures the small-cavity oil pressure of the telescopic oil cylinder.

In Step 303, the controller controls an output electrical signal according to a large-cavity oil pressure fed back by the large-cavity pressure sensor and a small-cavity oil pressure fed back by the small-cavity pressure sensor, and, by means of the electrical signal, controls a change of the amount of hydraulic oil flowing into and out of the large cavity and the small cavity of the telescopic oil cylinder, so as to regulate the oil pressures in the large cavity and the small cavity.

According to an embodiment of the present invention, Step 303 further includes: determining whether the large-cavity oil pressure and the small-cavity oil pressure do not exceed their respective limit values, whether the oil pressure difference between the large cavity and the small cavity is normal, and whether the fluctuation in oil pressures in the large cavity and the small cavity is normal, and, if yes, regulating the oil pressures in the large cavity and the small cavity according to the oil pressures fed back. Here, the limit values refer to the upper limit and the lower limit.

If the large cavity oil pressure and small cavity oil pressure exceed their respective limit values, the oil pressure difference between the large cavity and the small cavity is abnormal, and/or the fluctuation in oil pressures in the large cavity or the small cavity is abnormal, the abnormality is treated.

Figure 7:
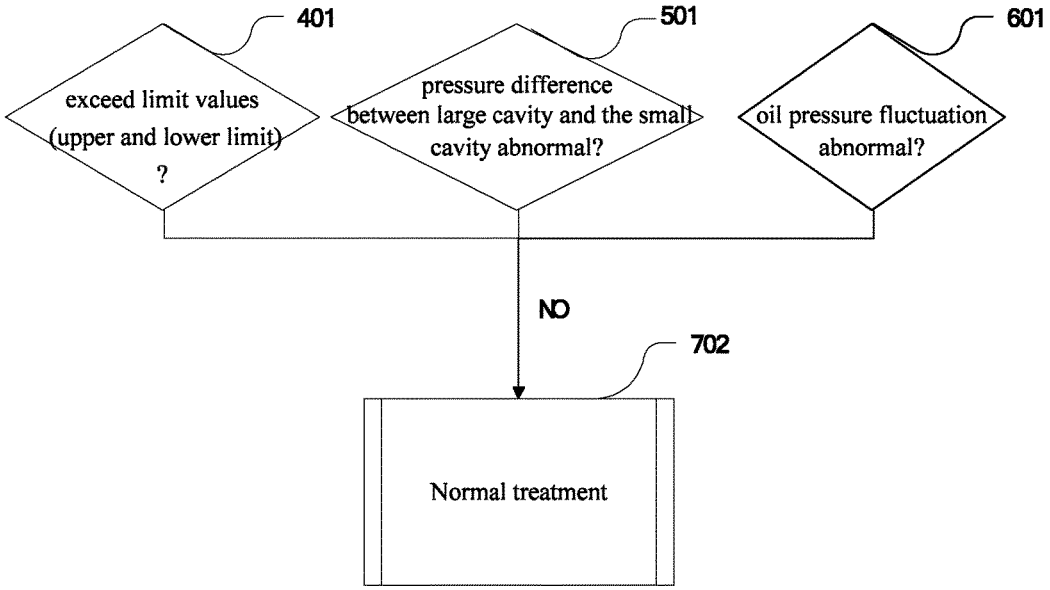
FIG. 7 is a flowchart of an apparatus for detecting and protecting a telescopic oil cylinder according to an embodiment of the present invention when detecting normality.

FIG. 7 is a flowchart of an apparatus for detecting and protecting a telescopic oil cylinder according to an embodiment of the present invention detecting normality.

When it is detected that the oil pressure in the telescopic oil cylinder does not exceed a limit value, the oil pressure difference between the large cavity and the small cavity is normal, and the fluctuation in oil pressure is normal, Step 702 is performed, namely a normal treatment is carried out.

The normal treatment includes: normal oil pressure display, normal control on apparatus, etc.

In one embodiment of the present invention, when the opening size of the solenoid valve is regulated, the regulation may be made as follows:

$$\Phi=F(J, A, B)$$

wherein $\Phi$ is the opening size of the solenoid valve;

J is the magnitude of the handle value corresponding to the stretching and contracting motion;

A is the large-cavity oil pressure in the telescopic oil cylinder; and

B is the small-cavity oil pressure in the telescopic oil cylinder.

The opening size of the solenoid valve and/or the displacement of the pump are regulated according to the large-cavity oil pressure in the telescopic oil cylinder, the small-cavity oil pressure in the telescopic oil cylinder and the magnitude of the handle value corresponding to the stretching and contracting motion. Thus, the smooth operation performance of the system may be improved.

The opening size of the solenoid valve is quantified in the range of 0-100%, the magnitude of the handle value corresponding to the stretching and contracting motion is quantified in the range of 0-100%, and the oil pressures in the large cavity and the small cavity is quantified in the range of 0-100%. It should be understood that in order to ensure the fine motion property and speed of the stretching and contracting motion, the handle value, the opening size of the solenoid valve, the pressure values of the large cavity and the small cavity, and the stretching/contracting speed are associated, but not in a general linear relationship. In an embodiment of the present invention, for example during the stretching motion with the cylinder being idle, when the handle value is in the range of 10-40%, in order to ensure that the boom stretching speed is in the range of 0-20%, the pressure value of the large cavity should be kept in the range of 20-25%, and the opening of the solenoid valve corresponding to the large cavity should be regulated in the range of 0-35%, so as to meet the requirement. For another example, when the handle value is in the range of 80-100%, in order to ensure that the boom stretching speed is in the range of 60-100%, the pressure value of the large cavity should be kept in the range of 35-45%, and the opening of the solenoid valve corresponding to the large cavity should be regulated in the range of 70-100%, so as to meet the requirement. In the whole process, there should be a back pressure in the range of 1.5-2% for the pressure value of the small cavity, and the opening of the solenoid valve corresponding to the small cavity should be controlled in the range of 80-85%. However, it should be understood that the embodiments described above are exemplary only, and cannot limit the present invention.

The process of implementing the stretching and contracting motion is illustrated above by taking it as an example that the oil pressure difference between the large cavity and the small cavity is regulated by controlling the opening size of the solenoid valve. In the present invention, it is also possible to regulate the pressure difference between the large cavity and the small cavity, and regulate the stretching and contracting motion and the speed thereof by controlling the engine and oil pump, or controlling the oil pump alone. For example, when the oil pressure is abnormal and the stretching and contracting motion is made artificially and "forcibly", the controller limits the associated output, so that the speed of stretching and contracting motion is reduced to 15% of the maximum speed, thus helping the system safely and smoothly makes the stretching and contracting motion.

In other embodiments, the Φ above may also be the output torque of the engine or the power of the oil pump. Similar description is not repeated here.

In an embodiment of the present invention, when the motion of stretching with a boom is made, with the increase of the number of the stretching booms, the load of the telescopic oil cylinder is heavier and heavier; in order to ensure enough pressure support, at that time the large-cavity oil pressure in the telescopic oil cylinder has to become higher, and thus the engine has to output a larger torque at that time. Meanwhile, when the motion of stretching with the cylinder being idle (stretching without a boom) is made, since the gravity of booms is taken away, the load will become lighter, and thus the engine no longer has to provide too large a torque at that time. While the power needed by the engine is ensured, the effect of energy-saving and emission-reduction can be achieved by avoiding the 'light load drive' phenomenon.

In an embodiment of the present invention, one or more set values may be set for the large cavity oil pressure and small cavity oil pressure; for example, two set values are set; during the motion of stretching with a boom, the small-cavity pressure is normal, but the large-cavity pressure gradually increases; if the large-cavity oil pressure is higher than the first set value and there is still no motion, an early warning treatment is provided (for example sound and light alarm); if the large-cavity oil pressure is higher than the second set value (the second set value is greater than the first set value), the solenoid valve is closed to stop the motion of stretching with a boom, so as to prevent the telescopic system from being damaged by overpressure, for example cylinder blow-up.

Figure 4:
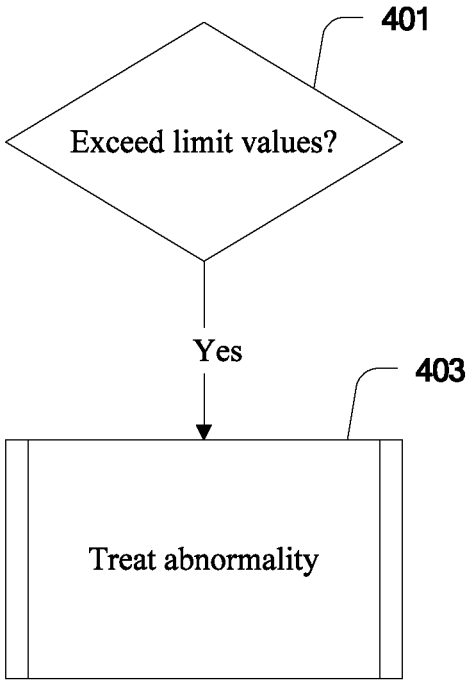
FIG. 4 is a flowchart of an apparatus for detecting and protecting a telescopic oil cylinder according to an embodiment of the present invention when detecting that pressures exceed limit values.
Figure 5:
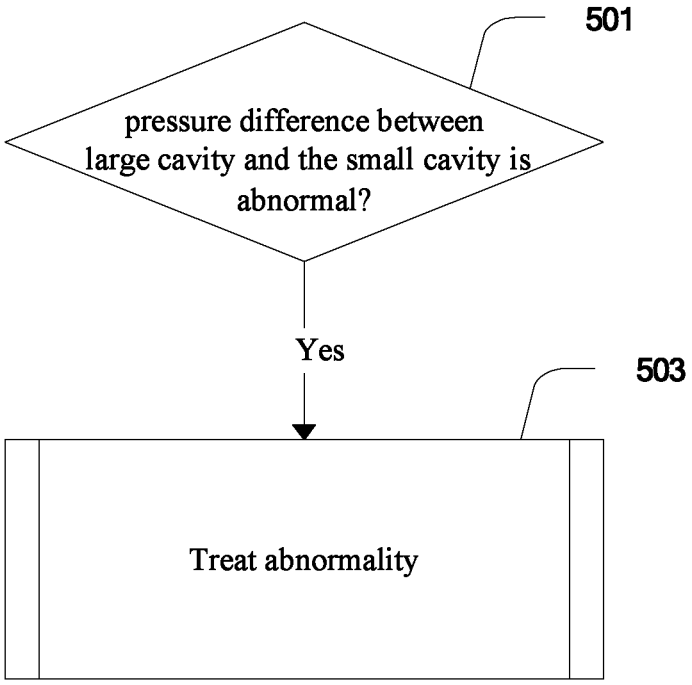
FIG. 5 is a flowchart of an apparatus for detecting and protecting a telescopic oil cylinder according to an embodiment of the present invention when detecting that the oil pressure difference between the large cavity and the small cavity is abnormal.
Figure 6:
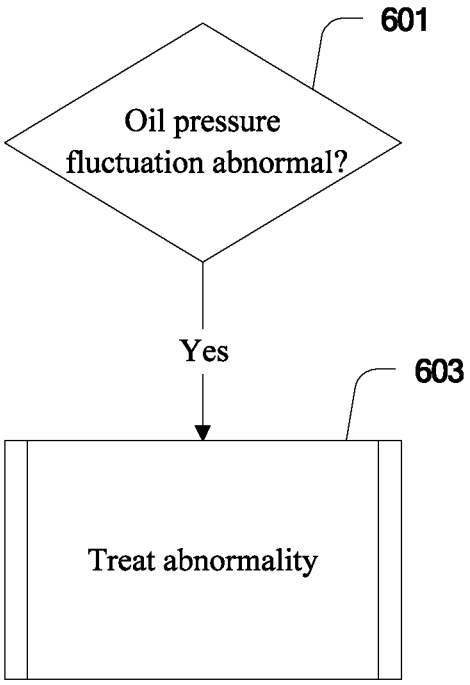
FIG. 6 is a flowchart of an apparatus for detecting and protecting a telescopic oil cylinder according to an embodiment of the present invention when detecting that a fluctuation in oil pressure is abnormal.

Shown in FIGS. 4-6 is a process of treatment for abnormality. The skilled in the art should understand that the sequence of performing the three detecting operations, namely detecting whether the pressures in the telescopic oil cylinder exceeds limit values (401), detecting whether the oil pressure difference between the large cavity and the small cavity is abnormal (501), and detecting whether the fluctuation in oil pressure in the telescopic oil cylinder is abnormal (601), may be determined by the skilled in the art themselves according to the specific circumstances and needs.

Various abnormal cases are illustrated below respectively in conjunction with the accompanying drawings and the specific embodiments.

FIG. 4 is a flowchart of an apparatus for detecting and protecting a telescopic oil cylinder according to an embodiment of the present invention when detecting that pressures exceed limit values. In Step 401, it is detected whether the large-cavity oil pressure and the small-cavity oil pressure in the telescopic cavity exceed their respective limit values, including upper and lower limits. For different cranes, the skilled in the art can set different limit values. For example, the upper limit for the large-cavity oil pressure is 160 bar, the lower limit for the large-cavity oil pressure is 5 bar, the upper limit for the small-cavity oil pressure is 240 bar, and the lower limit for the small-cavity oil pressure is 8 bar. It should be understood that the above mentioned oil pressure limit values are exemplary only and should not be construed as limiting the present invention.

When it is detected that the oil pressures in the telescopic cavity exceed their respective limit values, Step 403 is performed, namely the abnormality is treated.

The modes of treating the abnormality include:

if it is determined that the oil pressure is relatively low, giving an alarm, and checking whether the hydraulic oil pipeline suffers damage and oil leakage, whether the opening state and closing state of the corresponding solenoid valve 209 are normal, etc.; and if it is determined that the oil pressure is relatively high, giving an alarm, regulating the oil pressure difference between the large cavity and the small cavity automatically by the controller 203 for deceleration treatment, checking whether the load is too heavy, whether the jib is deformed, whether lubrication and maintenance are done, whether the opening state and closing state of the corresponding solenoid valve 209 are normal, etc.

FIG. 5 is a flowchart of an apparatus for detecting and protecting a telescopic oil cylinder according to an embodiment of the present invention when detecting that the oil pressure difference between the large cavity and the small cavity is abnormal; in Step 501, it is detected whether the large-cavity oil pressure difference and the small-cavity oil pressure difference are abnormal.

The skilled in the art should understand that the abnormal state of the oil pressure difference between the large cavity and the small cavity varies from crane to crane; for example, the oil pressure difference between the large cavity and the small cavity that is permissible for the cylinder varies from crane to crane; for the same crane, the oil pressure difference between the large cavity and the small cavity varies according to different conditions; for example, during the boom stretching motion and the boom contracting motion, the variation in the required speed results in a variation in the oil pressure difference between the large cavity and the small cavity. The skilled in the art should understand that the abnormal state of the large cavity and the small cavity of the telescopic oil cylinder of the crane under detection may be determined by numerously repeatedly detecting the oil pressure difference between the large cavity and the small cavity that is permissible for the telescopic oil cylinder of the crane, stretching and contracting motion, etc., description of which is not repeated here.

When it is determined that the large-cavity oil pressure difference and the small-cavity oil pressure difference are abnormal, Step 503 is performed, namely the abnormality is treated.

Accordingly, the treatment for abnormality includes:

if it is determined that the large-cavity oil pressure difference and/or small cavity oil pressure difference is too big, regulating the engine 207, oil pump 211 and/or solenoid valve 209 to increase the oil pressure in the cavity with a lower oil pressure and/or reduce the oil pressure in the cavity with a higher oil pressure; and if it is determined that the large cavity oil pressure difference and/or small cavity oil pressure difference are too small, regulating the engine 207, oil pump 211 and/or solenoid valve 209 to reduce the oil pressure in the cavity with a lower pressure and/or increase the oil pressure in the cavity with a higher pressure.

FIG. 6 is a flowchart of an apparatus for detecting and protecting a telescopic oil cylinder according to an embodiment of the present invention when detecting that the fluctuation in oil pressure is abnormal. In Step 601, it is detected whether the fluctuation in oil pressure is abnormal.

The skilled in the art should understand that the fluctuation in oil pressure being normal means that the fluctuation in oil pressure is in the allowed range of fluctuation in oil pressure; the fluctuation in oil pressure being abnormal means that the fluctuation in oil pressure is outside the allowed range of fluctuation in oil pressure. The range of fluctuation in oil pressure varies according to the crane, and according to different running states of the same crane, for example whether the boom stretches or contracts. The range of fluctuation in oil pressure of the telescopic oil cylinder of the crane may be determined by numerously repeatedly testing, description of which is not repeated here.

When it is detected that the fluctuation in oil pressure in the telescopic oil cylinder is abnormal, Step 603 is performed, namely the abnormality is treated.

Accordingly, the treatment for abnormality includes:

giving an alarm, and regulating the engine 207, oil pump 211 and/or solenoid valve 209, so that the fluctuation in oil pressure is normal.

In an embodiment of the present invention, when a stretching and contracting motion is made and the handle signal tends towards stability, the oil pressures in the large cavity and the small cavity should fluctuates in a narrow range (obtained by numerously repeatedly testing); if the range of fluctuation is outside a wide range, the problem may be caused by a sudden failure, in which case if the handle signal does not return to zero, the opening of the solenoid valve is controlled so that it becomes smaller until closed, namely the speed is reduced until the motion is stopped; if the handle signal returns to zero, it indicates that the operator is aware of the failure and artificially stops the motion, the solenoid valve is closed according to the handle signal, and the motion is stopped. The wide range is generally 1.5-3 times of the normal narrow range.

The abnormal cases where the oil pressure in the telescopic oil cylinder is too high/too low, the oil pressure difference in the large cavity and the small cavity is too big/too small, the oil pressure fluctuates abruptly, etc., are treated by means of the above mentioned treatment for abnormity, so as to be beneficial to the normal running and effective protection of apparatus.

Figure 8:
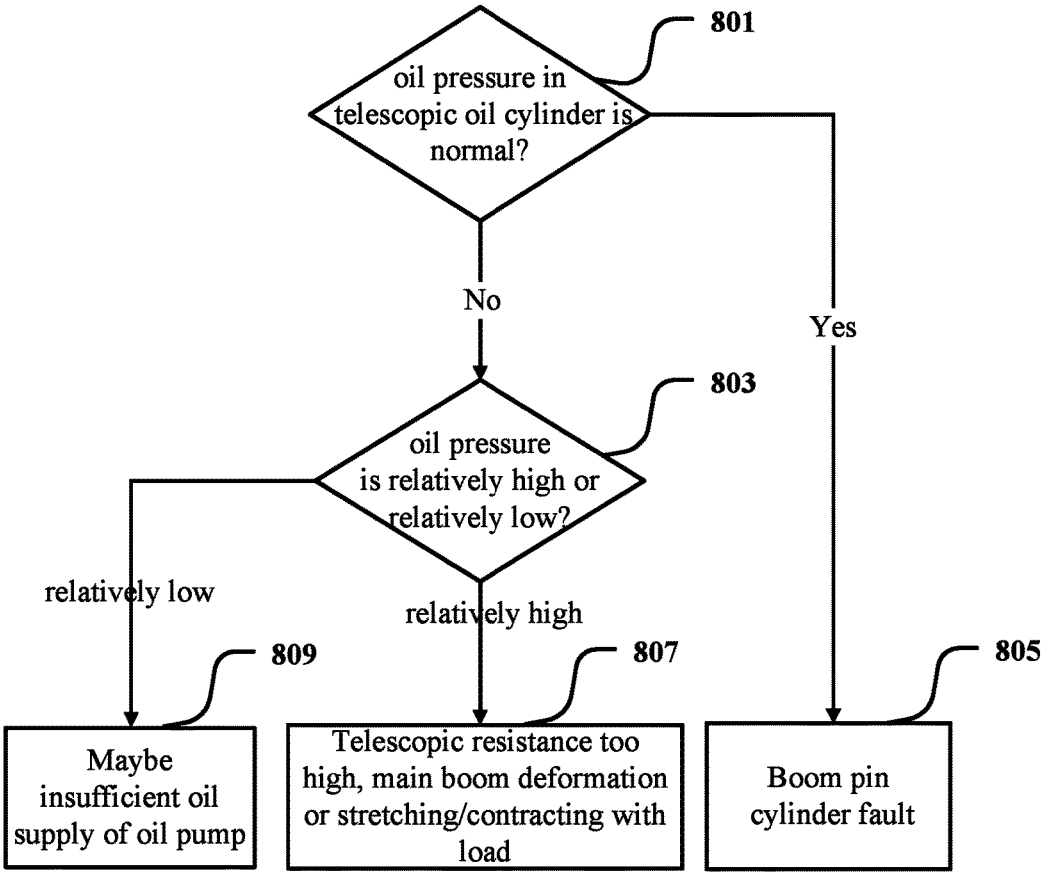
FIG. 8 is a flowchart of an apparatus for detecting and protecting a telescopic oil cylinder according to an embodiment of the present invention determining that a boom pin cannot be pulled out as a failure.

FIG. 8 is a flowchart of an apparatus for detecting and protecting a telescopic oil cylinder according to an embodiment of the present invention determining that a boom pin cannot be pulled out as a failure. In practical work, it is often encountered that the boom pin cannot be pulled out as a failure; according to an invention of the present invention, the cause of such a failure that the boom pin cannot be pulled out may be analyzed by oil pressure detection of the telescopic oil cylinder.

In an embodiment of the present invention, when the operation of pulling the boom pin is performed, the oil pressures in the large cavity and the small cavity are detected; if the oil pressure in one of them is lower than the lower limit, in order to prevent non-smooth motion phenomena such as 'abrupt stretching' and 'abrupt contracting' which are caused by too low an oil pressure in one of them, the motion of pulling the boom pin is prohibited, a sound/light alarm treatment is carried out, and the 'under pressure' fault is reported. For example, when the boom pin is pulled and the boom contracts, if the large-cavity oil pressure is less than the limit value of the large-cavity pressure, the motion of pulling the boom pin is not made; instead, oil is first supplied to the large cavity until the pressure is not less than the set value, and only then the motion of pulling the boom pin can be made.

In an embodiment of the present invention, when it is encountered that the boom pin cannot be pulled out as a failure:

If there is no 'under pressure' fault, in Step 801, it is determined whether the oil pressure in the telescopic oil cylinder is normal.

If the oil pressures in the large cavity and the small cavity of the telescopic oil cylinder are normal, the process proceeds to Step 805; if it is determined that there may be a boom pin cylinder fault, the fault of the boom pin being unable to be pulled out is reported.

If the oil pressure of the telescopic oil cylinder is abnormal, the process proceeds to Step 803, and it is determined whether the large-cavity oil pressure is relatively high or relatively low: if high, the process proceeds to Step 807, and it is determined whether the telescopic resistance is too great, for example due to deformation of the main boom, or stretching and contracting with a boom, etc.; if the pressure is not higher than the upper limit value, pressurization is continued; if the pressure is higher than the upper limit value, pressurization is stopped and the over pressure fault is reported; if the pressure is relatively low, the process proceeds to Step 809, and it is determined that the oil pump may have insufficient oil supply, etc. What is mentioned here as relatively high/relatively low varies according to different cranes or different operating conditions, and it may be determined by the skilled in the art whether the oil pressure is relatively high or relatively low in a specific case. For example, for a certain model of crane, an oil pressure value may be so set, and when the pressure is greater than the oil pressure value, it is considered to be relatively high; otherwise, relatively low. Those skilled in the art should appreciate that what is mentioned here are only taken as examples, and should not be construed as limiting the invention.

According to the present invention, the state of oil pressure in the telescopic oil cylinder is obtained by detecting the oil pressures in the large cavity and the small cavity of the telescopic oil cylinder of the single-cylinder pin plug-in system, and it is used for stretching/contracting control of the telescopic oil cylinder and treatment of the abnormal state, so prior to risk occurrence, such treatments as early warning and decelerating may be provided, the causes for the failure may be analyzed, and such functions as control logic may be optimized, so as to realize the effective protection of the whole telescopic system.

So far, the invention has been described in detail. To avoid shielding the concept of the invention, some details well-known in the art is not described. From the above description, those skilled in the art can fully understand how to implement the technical solutions disclosed herein.

The method and apparatus of the invention may be implemented in many ways. For example, the method and apparatus of the invention can be implemented by software, hardware, firmware, or any combination of software, hardware and firmware. The above sequence for the steps of the method is only for the purpose of illustration, and the steps of the method of the present invention are not limited to the sequence specifically described above, unless otherwise specifically stated. Further, in some embodiments, the present invention may also be implemented as a program recorded in a recording medium, which program comprises machine readable instructions for implementing the method according to the present invention. Accordingly, the present invention also covers a recording medium storing a program for executing the method according to the present invention.

Although certain embodiments of the present invention has been described in detail by way of example, those skilled in the art should appreciate that the above examples are for illustration only and not intended to limit the scope of the invention. Those skilled in the art should appreciate that the modifications of the above embodiments may be made without departing from the scope and spirit of the present invention. The scope of the invention is defined by the appended claims.

What is claimed is:

1. An apparatus for detecting and protecting a telescopic oil cylinder of a crane, comprising a large-cavity pressure sensor, a small-cavity pressure sensor, a controller, a telescopic oil cylinder, and a telescopic oil cylinder regulator, wherein the large-cavity pressure sensor is respectively connected with the telescopic oil cylinder and the controller and measures an oil pressure in a large cavity of the telescopic oil cylinder;

the small-cavity pressure sensor is respectively connected with the telescopic oil cylinder and the controller and measures an oil pressure in a small cavity of the telescopic oil cylinder;

the controller is connected with the telescopic oil cylinder regulator;

the telescopic oil cylinder regulator is connected with the telescopic oil cylinder;

the controller controls an electrical signal output to the telescopic oil cylinder regulator according to a large-cavity oil pressure fed back by the large-cavity pressure sensor and a small-cavity oil pressure fed back by the small-cavity pressure sensor, and, by means of the electrical signal, controls a change of the amount of hydraulic oil flowing into and out of the large cavity and the small cavity of the telescopic oil cylinder, so as to regulate the oil pressures in the large cavity and the small cavity; and if the controller determines that the large-cavity oil pressure and the small-cavity oil pressure exceed limit values, an oil pressure difference between the large cavity and the small cavity is abnormal, and/or a fluctuation in oil pressures in the large cavity and the small cavity is abnormal, abnormality is treated.

2. The apparatus for detecting and protecting a telescopic oil cylinder of a crane according to claim 1, further comprising:

a proximity switch and/or a length measuring device, wherein the proximity switch is respectively connected with the controller and the telescopic oil cylinder, and the length measuring device is respectively connected with the controller and the telescopic oil cylinder.

3. The apparatus for detecting and protecting a telescopic oil cylinder of a crane according to claim 1, further comprising:

a proximity switch and/or a length measuring device, wherein the proximity switch is respectively connected with the controller and the telescopic oil cylinder, and the length measuring device is respectively connected with the controller and the telescopic oil cylinder.

4. The apparatus for detecting and protecting a telescopic oil cylinder of a crane according to claim 1, wherein:

the controller determines whether the large-cavity oil pressure and the small-cavity oil pressure do not exceed limit values, whether the oil pressure difference between the large cavity and the small cavity is normal, and whether the fluctuation in oil pressures in the large cavity and the small cavity is normal, and, if the controller determines that the large-cavity oil pressure and the small-cavity oil pressure do not exceed limit values, the oil pressure difference between the large cavity and the small cavity is normal, and the fluctuation in oil pressures in the large cavity and the small cavity is normal, regulates the oil pressures in the large cavity and the small cavity according to the oil pressures fed back.

5. The apparatus for detecting and protecting a telescopic oil cylinder of a crane according to claim 1, wherein:

the large-cavity pressure sensor and the small-cavity pressure sensor are respectively located in the cavity of the telescopic oil cylinder and/or an oil way pipeline.

6. The apparatus for detecting and protecting a telescopic oil cylinder of a crane according to claim 5, further comprising:

a proximity switch and/or a length measuring device, wherein the proximity switch is respectively connected with the controller and the telescopic oil cylinder, and the length measuring device is respectively connected with the controller and the telescopic oil cylinder.

7. The apparatus for detecting and protecting a telescopic oil cylinder of a crane according to claim 1, wherein:

the telescopic oil cylinder regulator refers to a solenoid valve, an oil pump, or an engine and oil pump.

8. The apparatus for detecting and protecting a telescopic oil cylinder of a crane according to claim 7, further comprising:

a proximity switch and/or a length measuring device, wherein the proximity switch is respectively connected with the controller and the telescopic oil cylinder, and the length measuring device is respectively connected with the controller and the telescopic oil cylinder.

9. The apparatus for detecting and protecting a telescopic oil cylinder of a crane according to claim 7, wherein:

the controller is connected with the solenoid valve, or the controller is connected with the oil pump, or the controller is successively connected with the engine and oil pump, so as to control a change of the amount of hydraulic oil flowing into and out of the large cavity and the small cavity by changing engine speed, oil pump displacement or solenoid valve opening size.

10. The apparatus for detecting and protecting a telescopic oil cylinder of a crane according to claim 9, further comprising:

a proximity switch and/or a length measuring device, wherein the proximity switch is respectively connected with the controller and the telescopic oil cylinder, and the length measuring device is respectively connected with the controller and the telescopic oil cylinder.

11. A method for detecting and protecting a telescopic oil cylinder of a crane, comprising steps that a large-cavity pressure sensor measures a large-cavity oil pressure of the telescopic oil cylinder;

a small-cavity pressure sensor measures a small-cavity oil pressure of the telescopic oil cylinder; and a controller controls an output electrical signal according to a large-cavity oil pressure fed back by the large-cavity pressure sensor and a small-cavity oil pressure fed back by the small-cavity pressure sensor, and, by means of the electrical signal, controls a change of an amount of hydraulic oil flowing into and out of the large cavity and the small cavity of the telescopic oil cylinder, so as to regulate the oil pressures in the large cavity and the small cavity; and if the controller determines that the large-cavity oil pressure and the small-cavity oil pressure exceed limit values, an oil pressure difference between the large cavity and the small cavity is abnormal, and/or a fluctuation in the oil pressures in the large cavity and the small cavity is abnormal, abnormality is treated.

12. The method for detecting and protecting a telescopic oil cylinder of a crane according to claim 11, comprising steps that the controller determines whether the large-cavity oil pressure and the small-cavity oil pressure do not exceed limit values, whether the oil pressure difference between the large cavity and the small cavity is normal, and whether the fluctuation in oil pressures in the large cavity and the small cavity is normal, and, if the controller determines that the large-cavity oil pressure and the small-cavity oil pressure do not exceed limit values, the oil pressure difference between the large cavity and the small cavity is normal, and the fluctuation in oil pressures in the large cavity and the small cavity is normal, regulates the oil pressures in the large cavity and the small cavity according to the oil pressures fed back.

13. The method for detecting and protecting a telescopic oil cylinder of a crane according to claim 11, comprising steps that the controller is connected with a solenoid valve, or the controller is connected with an oil pump, or the controller is successively connected with an engine and the oil pump, so as to control an electrical signal output to the solenoid valve, oil pump or engine, and by means of the electrical signal, change engine speed, oil pump displacement or solenoid valve opening size and then control a change of the amount of hydraulic oil flowing into and out of the large cavity and the small cavity of the telescopic oil cylinder.

14. The method for detecting and protecting a telescopic oil cylinder of a crane according to claim 13, comprising steps that the controller determines whether the large-cavity oil pressure and the small-cavity oil pressure do not exceed limit values, whether the oil pressure difference between the large cavity and the small cavity is normal, and whether the fluctuation in oil pressures in the large cavity and the small cavity is normal, and, if the controller determines that the large-cavity oil pressure and the small-cavity oil pressure do not exceed limit values, the oil pressure difference between the large cavity and the small cavity is normal, and the fluctuation in oil pressures in the large cavity and the small cavity is normal, regulates the oil pressures in the large cavity and the small cavity according to the oil pressures fed back.

* * * * *